United States Patent [19]

Kulik

[11] 4,213,221

[45] Jul. 22, 1980

[54] WIPER MOTION STOP

[75] Inventor: Alphonse C. Kulik, Ipswich, Mass.

[73] Assignee: USM Corporation, Farmington, Conn.

[21] Appl. No.: 954,484

[22] Filed: Oct. 25, 1978

[51] Int. Cl.[2] ..... A43D 21/00

[52] U.S. Cl. ..... 12/12.4

[58] Field of Search ..... 12/10, 10.1, 10.5, 10.8, 12/12, 12.4, 12.5, 14.4

[56] References Cited

U.S. PATENT DOCUMENTS

| | | | |
|---|---|---|---|
| 2,990,559 | 7/1961 | Gilbride | 12/12.4 |
| 3,268,930 | 8/1966 | Rockwell et al. | 12/12.4 |

*Primary Examiner*—Patrick D. Lawson

*Attorney, Agent, or Firm*—Donald N. Halgren; Richard B. Megley; Vincent A. White

[57] ABSTRACT

A machine for pulling and lasting a shoe upper has a mechanism for adjusting the amount of rotational travel of lasting wipers on a wiper head which move toward and rotate against the shoe during the lasting operation. The mechanism comprises a rotatably adjustable knob connected to a correspondingly adjustable threaded shaft arranged in the movable wiper head. The threaded shaft contacts the frame of the machine at the lowermost position of the wiper head, and prevents further advance of the head and further rotational advance of the wipers. The machine operator may preset the degrees of the wiper's rotational stroke by adjustment of the threaded shaft with respect to the wiper head, for the particular size shoe being lasted. Rotation of the adjustable knob also provides an indication of the size of each of the wiper's rotational stroke on a gage behind the knob.

5 Claims, 3 Drawing Figures

WIPER MOTION STOP

BACKGROUND OF THE INVENTION

1. Field of the Invention

This invention relates generally to shoe upper forming machines, and more particularly, is directed to size adjustment mechanisms on a machine for performing a pulling and lasting operation on the forepart regions of a shoe.

2. Prior Art

Certain problematical areas of shoe lasting, include the quality lasting of welt shoes, where, during the lasting operation, a particular limited movement of the wipers is required so that the upper will be pressed uniformly against the insole rib without damaging the insole rib by bending it excessively or otherwise misaligning the rib. A mechanism to help alleviate the problem of excess wiper motion at least to the sides of flat lasted shoes has been shown in U.S. Pat. No. 3,196,470 to Bowler, and is assigned to the assignee of the present invention. The mechanism shown in this patent is directed towards the "initial" position of each wiper to permit lasting of particular contoured soles, by utilizing therewith a plurality of adjustable knobs and linkages. It does not direct the invention to controlled displacement of the ribs of a welt insole, to allow known counteraction of the pulling on the ribs after the wipers are removed. The controlled displacement of the ribs in an inward direction is necessary to neutralize the after-wipe outward pulling forces to thereby prevent any outwardly pulled ribs on the insole from otherwise getting in the way of the stitching needle.

It is an object of the present invention to provide a mechanism which will permit the exact preselecting of the rotational distance of travel of the wiper head and associated wipers and stopping of that rotational motion against the toe and side portions of a shoe being lasted, to permit a controlled displacement of the ribs of the insole on the shoe being lasted.

It is another object of the present invention to simplify the mechanism required to limit and govern the motion of the toe and forepart lasting wipers on a lasting machine.

It is a further object of the present invention, to provide a more exacting mechanism which will permit quality lasting on the margins of welt shoes.

BRIEF SUMMARY OF THE INVENTION

A machine for pulling and lasting a shoe upper about a last is provided with a wiper motion stop mechanism to permit the proper rotational positioning of the wipers as they are required for welt type shoes. The wiper stop mechanism comprises an adjustable stop screw that is rotatably attached to the wiper head and which will come against the frame of the machine to limit further advance of the wiper head and provide controlled rotation upon its reaching its preselected position. The adjustable screw is regulated through a flexible shaft to a turning knob, easily accessible by the machine operator. The wiper stop mechanism permits the machine operator to vary the stopping point of rotation during the angular sweep of the wipers with regard to the insole and particularly the ribs on the insole of the shoe being lasted and supported on the insole support plate, thereby permitting a variety of different size welt shoes to be properly and efficiently manufactured.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
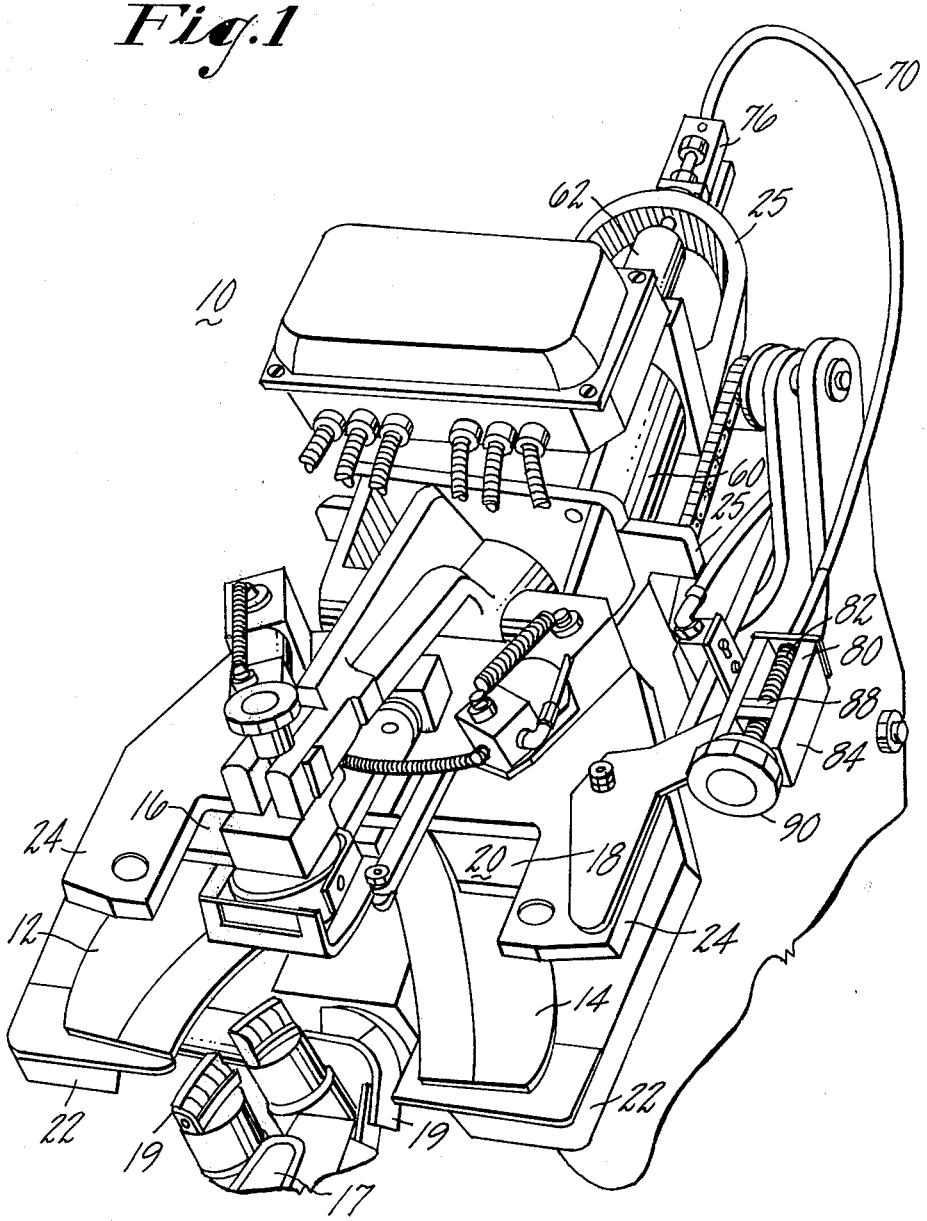
FIG. 1 is a perspective view of a part of a shoe pulling and lasting machine having the wiper stop mechanism of the present invention, therewith.

Referring to the drawings in detail, and particularly to FIG. 1, there is shown a shoe upper conforming machine 10, suitable for use in pulling and lasting a shoe upper in the toe and ball regions and the forepart of a shoe.

Figure 2:
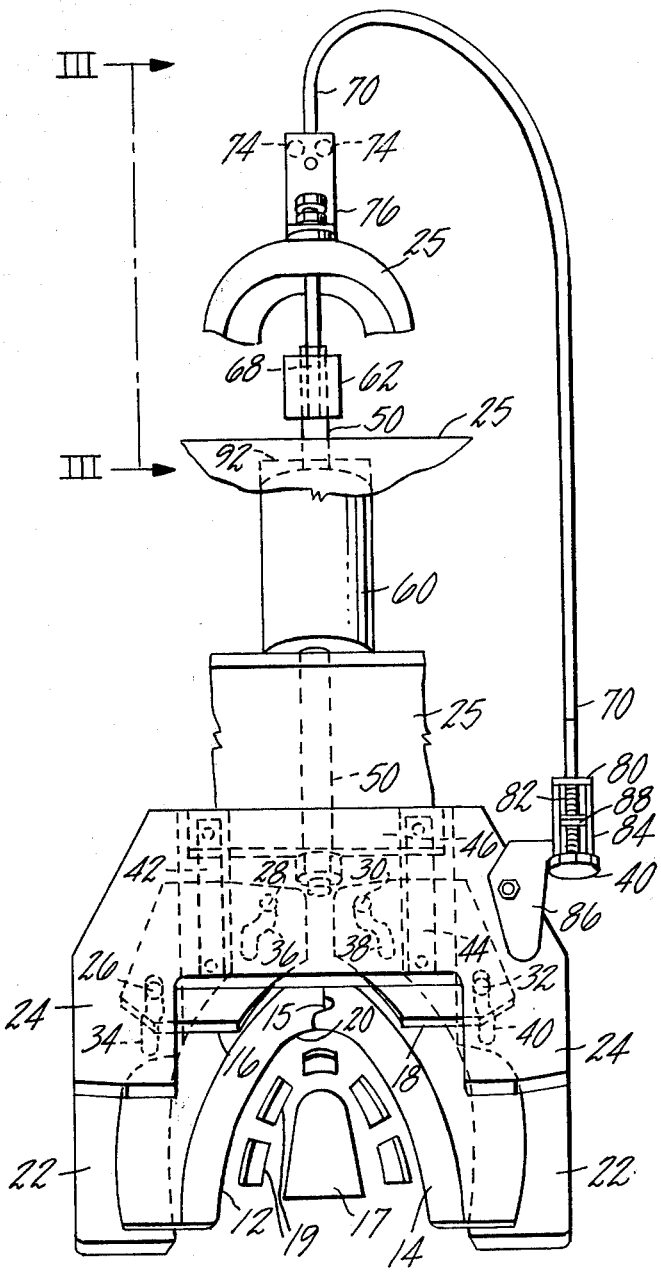
FIG. 2 is a plan view of a portion of the wiper head, including wiper stop mechanism of the present invention.
Figure 3:
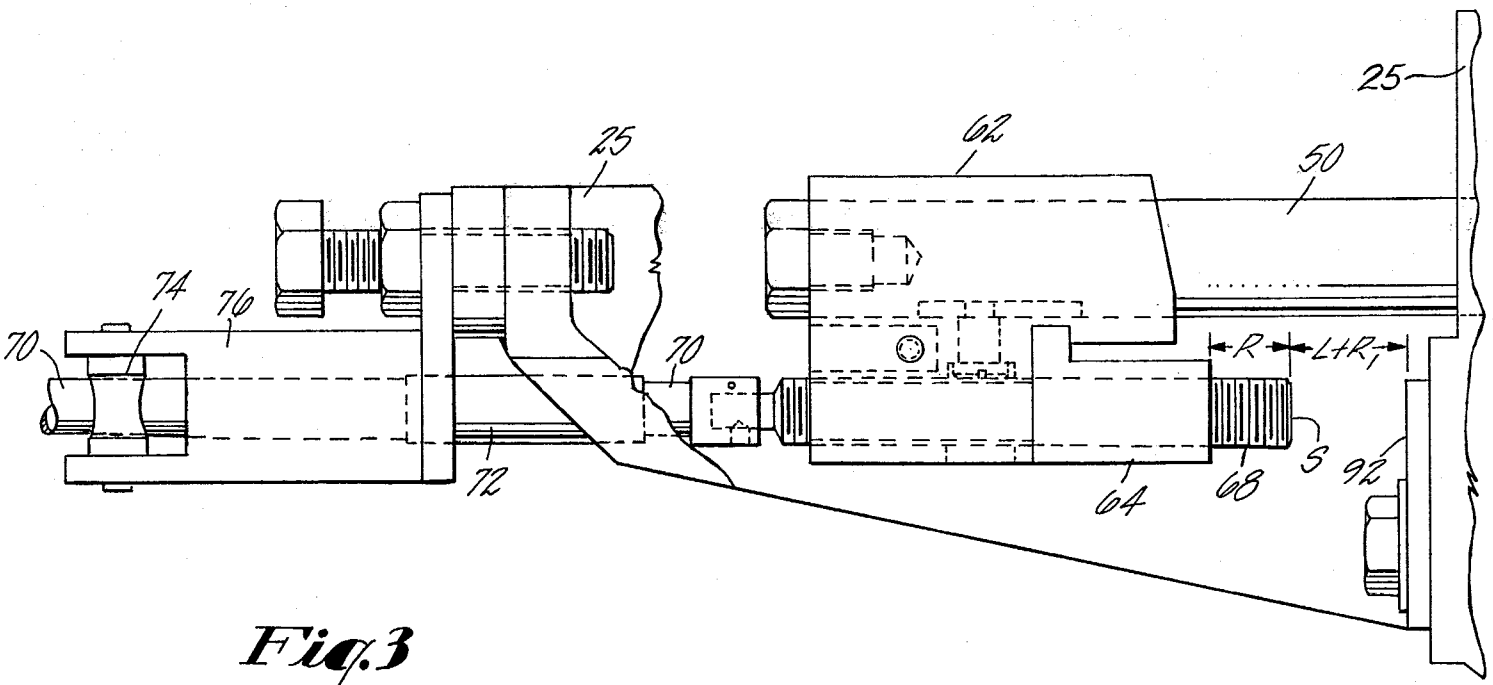
FIG. 3 is a side elevational view of the wiper stop mechanism.

A pair of wipers 12 and 14, are mounted in a pair of carriers 16 and 18 and pivot about a common axis 15. The carriers 16 and 18, are slidably received in a wiper head 20, between a lower frame support member 22 and a cam plate 24, which are attached to a frame 25 of the machine 10. The carriers 16 and 18, are provided with an arrangement of cam rolls 26, 28, 30 and 32, mounted on pins which extend upward from the carriers 16 and 18, as shown in FIG. 2. The cam rolls 26, 28, 30 and 32, are received in an arrangement of cam slots 34, 36, 38 and 40, in the underside of the cam plate 24, to guide the carriers 16 and 18, and their respective wipers 12 and 14, in their advancing and closing movements towards a shoe upper and last, not shown, supportable on a last insole support plate 17, and tightenable by a gripper arrangement 19. The carriers 16 and 18, are each connected, through a pair of pivotable links 42 and 44, to a cross-bar 46. The cross-bar 46 is attached to the lower end of a reciprocably movable piston rod 50. The piston rod 50 extends through a pressurizable piston and cylinder arrangement 60 which is secured to the frame 25. The upper end of the piston rod 50 extends through an adapter block 62 and is fixedly secured to the upper portion thereof as shown in FIG. 3. The lower portion of the adapter block 62 threadedly receives a rotatably adjustable threaded stop screw 68 and freely extends through a limit block 64 which hangs onto the lower forward end of the adapter block 62. The stop screw 68 has a rearward end which is fixedly attached to a flexible shaft 70. The flexible shaft 70 extends through a collar 72 which is arranged to extend through a rearward portion of the frame 25. The flexible shaft 70 may be disposed through a pair of flexible shaft guide-rolls 74. The guide rolls 74 are attached to a frame extension 76 which is also secured to the rearward portion of the frame 25. The flexible shaft 70 preferably extends around to the side of the machine 10, and is attached to a gauging adjustment control 80.

The gauging adjustment control 80, shown in FIGS. 1 and 2, comprises a threaded shaft 82 which is rotatively journalled in a control enclosure 84. The control enclosure 84 is secured to a bracket 86. The bracket 86 is attached to a portion of the cam plate 24 which is fixed to the frame 25. The bracket 86 is preferably disposed on the right hand side of the machine 10, as shown in FIG. 1.

One end of the threaded shaft 82 is fixedly attached to the end of the flexible shaft 70. A marker block 88 is slidably arranged with respect to the enclosure 84, and is visible through a top surface opening thereof. The enclosure 84 has graduation markings along one side which permit comparison with a mark on the visible surface of the marker block 88.

Rotation of the control knob 90 causes rotation of the threaded shaft 82. This causes linear movement of the marker block 88 on the threaded shaft 82 with respect to the graduation markings on the side of the enclosure 84. Rotation of the control knob 90 also causes rotation of the flexible shaft 70, which causes a corresponding rotation in the stop screw 68. The rotation of the stop screw 68 causes axial displacement thereof with respect to the adapter block 62 and the piston rod 50. The unattached end of the stop screw 68 designated S in FIG. 3, is arranged to come into contact with a stop bracket 92. The stop bracket 92 is a portion of the frame 25.

The distance between the end S of the stop screw 68 and the forward end of the limit block 64, is designated R, as shown in FIG. 3. The distance R signifies the amount of follow-through rotation that the wiper plates 12 and 14, are permitted to travel once the linear motion of the wipers 12 and 14, has stopped, and after the preliminary rotation of the wipers 12 and 14, is completed. This amount of rotation may vary from about 5° to about 114 or more for welt type shoes. That is, the cam rolls 26, 28, 30 and 32 are permitted to follow through the cam slots 34, 36, 38 and 40 imparting only pure rotational motion into each of the wipers 12 and 14. The distance between the end S of the stop screw 68, and the stop bracket 92 is designated "L"$+R_1$ as shown in FIG. 3, and it defines the distance of linear travel imparted to the wiper head 20 and the wipers 12 and 14, as they advance toward the shoe being lasted, as well as defines the preliminary amount of rotation the wipers go through during their linear advance to the shoe being lasted. The preliminary amount of rotation may be about 5° which occurs even as the wipers 12 and 14, are still linearly advancing toward the shoe. The length of the stop screw 68 extending beyond the limit block 64 (the distance R), therefore determines the amount of additional rotation imparted to the wipers 12 and 14. That is, the cam rolls 26, 28, 30 and 32 may thereby be permitted to follow through at least a portion of their respective cam slots 34, 36, 38 and 40 depending upon the position of "S" with respect to the adapter block 62. Additionally, the limit block 64 may be removed, and the shaft 68 may be backed-off completely, to permit the adapter block 62 to strike the stop bracket 92, which would allow the wipers 12 and 14 to go through their entire rotational cycle, which is necessary for the lasting of certain flat lasted shoes.

In actual operation of the machine 10, when the pressurizable piston and cylinder arrangement 60 is actuated to move the wiper head 20 to cause the lasting of a shoe mounted on the machine 10, the wipers are advanced through their proper paths, by the interaction of the linkages 42, 44 and 46, and the cam rolls 26, 28, 30 and 32 in their respective slots 34, 36, 38 and 40. The stop screw 68 being secured to the adapter block 62 and the piston rod 50, advances a distance "L"$+R_1$, to the right as shown in FIG. 3, and hits the stop bracket 92 to prevent further linear and rotational motion of the wipers 12 and 14. The distance "R", shown in FIG. 3, may vary according to the direction and amount of rotation of the stop screw 68 with respect to stop screw holder 64, which direction and amount of rotation is predicated on the direction and amount of turns applied to the gauging knob 90. The rotation of the wipers 12 and 14, will vary according to the distance "R", which rotation may vary from 5° to 14° for each wiper.

The distance of travel and the degree of rotation of the wipers 12 and 14, between their fully withdrawn position and their lowermost "wipe" position will necessarily vary, depending upon the size and type of shoe being lasted on the machine 10. By adjustment of the control knob 90, with the proper position as determined by alignment of the marker block 88, with the proper mark on the graduations on the enclosure 84 permits preliminary and simple adjustment and control of the distance of rotational travel and motion of the wipers 12 and 14, for any particular shoe being lasted.

Thus there has been shown a mechanism for adjusting the amount of movement of an arrangement of wipers, that is simple and inexpensive to manufacture, and concomittantly simple, inexpensive and efficient to use in a shoe manufacturing facility.

It is intended that the appended claims are to be interpreted as exemplary only and not in a limiting sense.

I claim:

1. A shoe lasting machine for lasting a variety of sizes and styles of shoes therewith, said machine comprising:

a frame for supporting a wiper arrangement thereon; said wiper arrangement including:

a pair of wipers mounted on a wiper head;

a pair of wiper carriers for holding and guiding said wipers;

a wiper support plate arranged beneath said wiper carriers;

a cam plate arranged over said pair of wiper carriers to hold said wiper carriers against said support plate and help guide them therebetween in their opening and closing movements;

a piston and cylinder arrangement connected between said wipers and said frame for effecting the movement of said wipers with respect to said frame of said machine;

means for preselecting the rotational distance of travel of said wipers against the forepart of a shoe being lasted on said machine, permitting said machine to effectively and safely inwipe a variety of shoes.

2. A shoe machine for lasting shoes as recited in claim 1, wherein said preselecting means comprises an adjustable gauging device connected by a linking means to an adjustable stop device interconnected with said wipers, wherein calibration of said gauging device permits movement of said stop device with respect to said wipers.

3. A machine for lasting shoes as recited in claim 2, wherein said stop device is rotatively attached to a wiper head, which comprises said wipers, and is in abutting contact with a portion of said frame of said machine when said wiper head has advanced to its lowermost position in its lasting operation.

4. A machine for lasting shoes as recited in claim 3, wherein said stop device is a threaded shaft rotatively cooperating in a threaded receiver, said threaded receiver is fixedly attached on the upper end of a rod on said piston-cylinder arrangement.

5. A machine for lasting shoes as recited in claim 4, wherein rotational calibration of said gauging device causes corresponding rotation in said rotatable cable causing rotation in said threaded shaft, said threaded shaft contacting said frame of said machine at the lowermost desired position of said wiper head thereby preventing further advancement thereof, and thereby permitting a preselection of the rotational stopping point of the wipers in their course of lasting a forepart of a shoe.

* * * * *

Disclaimer 4,213,221.—*Alphonse Casimer Kulik;* Ipswich, Mass. WIPER MOTION STOP. Patent dated July 22, 1980. Disclaimer filed Mar. 18, 1981, by the assignee, *USM Corp.*

Hereby enters this disclaimer to claims 1, 2 and 3 of said patent.

[*Official Gazette July 14, 1981.*]